United States Patent [19]

Gauchon

[11] 4,379,082

[45] Apr. 5, 1983

[54] METHOD OF REMOVING RUTHENIUM CONTAMINATION FROM A LIQUID RADIOACTIVE EFFLUENT

[75] Inventor: Jean-Paul Gauchon, Pertuis, France

[73] Assignee: Commissariat a l'Energie Atomique, Paris, France

[21] Appl. No.: 145,320

[22] Filed: Apr. 29, 1980

[30] Foreign Application Priority Data

May 7, 1979 [FR] France ..... 79 11468

[51] Int. Cl.[3] ..... G21F 9/10

[52] U.S. Cl. ..... 252/631; 204/96; 204/228; 204/237; 210/715; 210/717; 210/719

[58] Field of Search ..... 252/301.1 W, 631; 423/2, 22; 210/715, 717, 719; 204/96, 228, 237

[56] References Cited

U.S. PATENT DOCUMENTS

| | | | |
|---|---|---|---|
| 3,330,771 | 7/1967 | Komatsu | 252/301.1 W |
| 3,853,980 | 12/1974 | Berton et al. | 252/301.1 W |
| 4,116,863 | 9/1978 | Berton et al. | 252/301.1 W |

FOREIGN PATENT DOCUMENTS 2063717 9/1971 France .

*Primary Examiner*—Deborah L. Kyle

*Attorney, Agent, or Firm*—Pearne, Gordon, Sessions, McCoy, Granger & Tilberry

[57] ABSTRACT

A method of removing ruthenium contamination from a radioactive liquid effluent, consisting in adding to said liquid effluent a reducing agent and copper ions, to form, in said effluent, a cuprous oxide precipitate on which the ruthenium is fixed, and subsequently separating the precipitate thus formed from the effluent, and an apparatus for performing this method.

8 Claims, 1 Drawing Figure

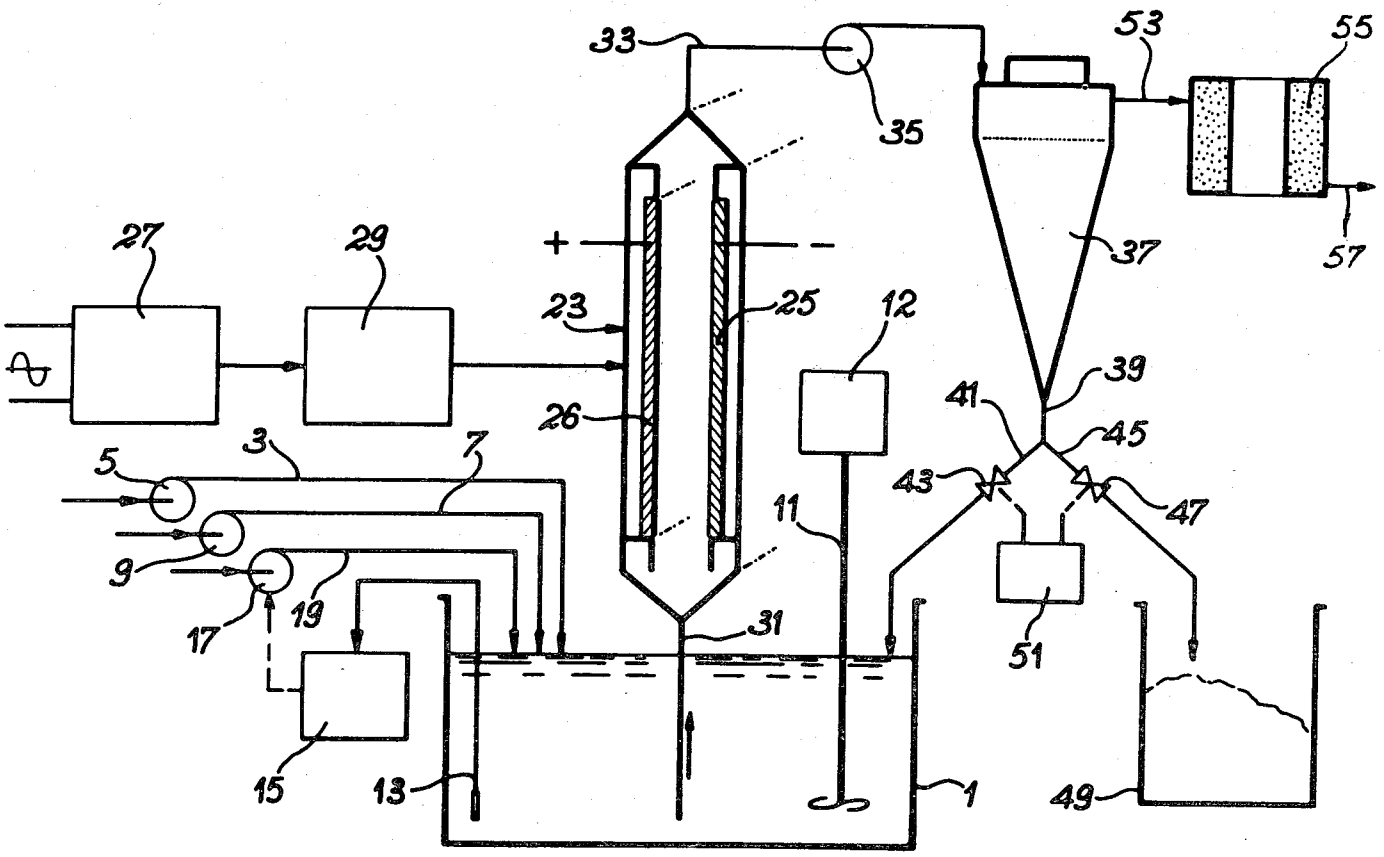
55
57
53
37
39
45
47
49
51
41
43
1
35
12
11
25
31
33
23
26
+
7
29
13
19
15
3
17
27
5
9

METHOD OF REMOVING RUTHENIUM CONTAMINATION FROM A LIQUID RADIOACTIVE EFFLUENT

BACKGROUND OF THE INVENTION

This invention relates to a method of removing ruthenium contamination from a liquid radioactive effluent, which can be used for crude effluents or for effluents which have previously been chemically treated by conventional methods.

It is known that radioactive effluents such as aqueous solutions obtained from the processing of irradiated nuclear fuels can be subjected to various chemical decontamination treatments to eliminate, in particular, ruthenium. The majority of these treatments consist in forming, inside the effluent which is to be treated, precipitates capable of fixing the ruthenium, for example by adding ferrous and copper ions to this effluent and then adjusting the pH of the effluent to a value of 7-8.5 in order to precipitate the corresponding copper and iron compounds.

However, the effluents thus treated still have an excessively high ruthenium content, so that additional treatment is required to reduce their residual ruthenium activity.

BRIEF SUMMARY OF THE INVENTION

More precisely, the present invention relates to a method of removing ruthenium contamination from a liquid radioactive effluent, which consists in forming, in the effluent, a precipitate capable of fixing the ruthenium.

The method according to the invention is characterised in that it consists in adding to said liquid effluent a reducing agent and copper ions to form, in the effluent, a cuprous oxide precipitate on which the ruthenium is fixed, and then separating the precipitate thus formed from the effluent. According to an advantageous feature of the method according to the invention the reducing agent consists of hydrazine.

According to another advantageous feature of the method of the invention, the pH of said liquid effluent is previously adjusted to a value of more than 7, preferably between 7 and 10, for example by the addition of soda.

According to a preferred embodiment of the method of the invention, the copper ions are produced directly in said effluent by an electrochemical method, by subjecting said effluent to electrolysis in a cell comprising a copper anode.

The method as characterised above advantageously makes use of the fact that by adding a reducing agent, preferably hydrazine, for example, in the form of a salt or hydrazine hydrate, to an effluent having a pH of more than 7, the oxido-reduction potential of the effluent is stabilised at appropriate values, for example of the order of $-120$ mV in relation to a saturated calomel electrode (SCE), so that, by adding copper ions $Cu^{2+}$, it is possible to form, in this effluent, a stable cuprous oxide precipitate on which the ruthenium is fixed, whilst the conversion of the copper salts into cuprous oxide occurs fairly rapidly.

Thus, satisfactory removal of the ruthenium contaminant is achieved.

Moreover, the method of the invention has the advantage of not producing an excessively large volume of precipitates or sludges and not requiring complex operations to ensure satisfactory separation of the sludges formed in the precipitation step.

In fact, when the copper ions are produced electrochemically, the volume of sludges formed in the effluent represents only 0.2 to 0.4% of the volume of effluent.

According to the invention, the quantities of hydrazine and copper ions added to said effluent are such that the molar ratio of hydrazine to the copper ions is between 0.5 and 1.

Advantageously, the quantity of hydrazine added to said effluent is between 1 and $2.10^{-3}$ moles of hydrazine per liter of effluent, and the quantity of copper ions added to said effluent is between 1 and $2.10^{-3}$ moles of copper ions per liter of effluent.

According to the invention, the precipitates formed in said effluent electrochemically may preferably be separated by means of a hydrocyclone, after which the effluent is subjected to filtration.

In certain cases, notably when copper ions are added, the separation and decantation of the precipitate can be made easier by adding an anionic polyelectrolyte to the effluent in which the precipitate is formed, in order to coagulate the precipitate obtained.

The invention also relates to an apparatus for performing this method.

This apparatus is characterised in that it comprises a tank provided with stirrer means, means for introducing into the tank the liquid effluent which is to be treated and the reducing agent, means for adjusting the pH of the effluent in the tank to the desired value, means for causing the effluent present in the tank to circulate in an electrolysis cell comprising a copper anode, means for recovering the effluent leaving said electrolysis cell, and means for separating from said effluent the cuprous oxide precipitate formed in said effluent when it passes into said electrolysis cell.

Preferably, the cell is provided with a polarity reverser and comprises two copper electrodes.

According to an advantageous feature of this apparatus, the means for separating the cuprous oxide precipitate formed in said effluent consist of a hydrocyclone and a filter.

Advantageously, the apparatus further comprises means for recycling at least some of the precipitate separated off into the tank.

BRIEF DESCRIPTION OF THE DRAWING

The invention will be more readily understood from the following description, given as an illustration and in no way restrictive, referring to the accompanying drawing, which shows a plant for removing ruthenium contamination from a radioactive liquid effluent according to the preferred embodiment of the method according to the invention.

DETAILED DESCRIPTION OF THE PREFERRED EMBODIMENTS

Referring to the accompanying drawing, it will be seen that the decontamination plant comprises a tank 1 which is supplied, on the one hand, with effluent to be treated, through a channel 3 provided with a pump 5 and, on the other hand, with hydrazine hydrate through a channel 7 provided with a pump 9.

The tank 1 is provided with a stirrer 11 driven by a motor 12 and a pH detector 13 associated with a control member 15 which actuates a pump 17 by means of which the quantity of soda required to adjust the pH of the effluent in the tank 1 to the desired value can be introduced into said tank 1 through the channel 19.

The plant also comprises an electrolysis cell 23 having two copper electrodes 25 and 26 which are supplied with electric current from an alternating current generator provided with a current rectifier 27 via a polarity reverser 29, by means of which the electrodes 25 and 26 can be connected alternately to the positive and negative poles of the electric current generator.

In order to produce the copper ions directly by the electrochemical method in the liquid effluent which is to be treated, this liquid effluent is made to circulate in the electrolysis cell 23 via channels 31 and 33 by means of a pump 35. On leaving the cell, the effluent is directed into a hydrocyclone 37 which separates off the sludges formed in the effluent, these sludges being extracted through a channel 39 and recycled into the tank 1 through a channel 41 provided with a valve 43, or evacuated through a channel 45 provided with a valve 47 into a storage container 49.

It should be pointed out that the alternating operation of the valves 43 and 47 is controlled by a timer 51.

On leaving the hydrocyclone 37, the separated liquid is evacuated through the channel 53, then filtered through a filter 55 and then extracted through the channel 57.

This plant operates as follows.

On the one hand, the liquid effluent to be treated is introduced into the tank 1 via the channel 3, and on the other hand the hydrazine is introduced through the channel 7, whilst the respective flow rates of introduction of these two liquids are controlled, by means of the pumps 5 and 9, so that a quantity of hydrazine corresponding to about $1.10^{-3}$ mole of hydrazine per liter of effluent is added to the effluent. The stirrer 11 is started up, so as to agitate the effluent contained in the tank 1, and the pH of this effluent is adjusted to a value substantially equal to 9 by adding soda thereto through the channel 19, this addition of soda being controlled by the device 15 which actuates the pump 17 and makes it possible to introduce the desired quantity of soda as a function of the pH detected by the pH indicator 13.

The effluent is then caused to circulate in the electrolysis cell 23 by starting up the pump 35, so that the circulation flow rate of the effluent in the cell 23 will make it possible to produce the desired quantity of copper ions in the effluent. On leaving the cell, the effluent, in which a cuprous oxide precipitate has formed, passes into the hydrocyclone 37, by means of which the sludges are separated off, some of them being recycled into the tank 1 by starting the timer 51 which controls the opening of valves 43 and 47 alternately. On leaving the hydrocyclone 37, the liquid is filtered on the filter 55, then evacuated through the channel 57.

To improve the farad yield of the electrodissolution of copper in the cell 23, the direction of travel of the current in the cell 23 is periodically reversed, by alternately connecting the electrodes 25 and 26 to the positive and negative poles of the electric current generator; a period of polarity reversal of 5 to 10 seconds gives the highest farad electrodissolution yields.

It should be pointed out that in this plant the recycling of the sludge into the tank 1 increases the contact time of the cuprous oxide with the effluent and thus improves the decontamination factor with regard to ruthenium 106 of the effluent treated.

The following examples illustrate the results obtained by performing the method according to the invention.

Hydrazine is used as the reducing agent in all these examples, as experience has shown that this reproducibly provides good stabilisation of the redox potential and was more advantageous to use than other reducers such as hydroxylamine, for example.

EXAMPLE 1

In this example, a crude effluent obtained from a processing plant for irradiated nuclear fuels is subjected to a decontamination treatment, this effluent having the following composition:

| Radiochemical activity in $\mu$ Ci $m^{-3}$ | |
|---|---|
| $^{106}Ru$ | 45,000 |
| $^{103}Ru$ | — |
| $^{125}Sb$ | 1,510 |
| $^{134}Cs$ | — |
| $^{137}Cs$ | 138,700 |
| $^{90}Sr$ | 47,000 |

50 mg/l of hydrazine monohydrate (corresponding to $1\times10^{-3}$ mol 1—1 of hydrazine) and 128 mg/l of copper ions added in the form of copper sulphate are added to this effluent, resulting in the formation of an orange-red precipitate on which the ruthenium is fixed. After the precipitate has been decanted, the content of ruthenium 106 in the supernatant liquid is determined and it is found that the ruthenium 106 decontamination factor (FD), which corresponds to the ratio between the ruthenium activities of the effluent before and after the decontamination treatment, has a value of 4.6.

EXAMPLE 2

In this example, a number of ruthenium decontamination tests are carried out on an effluent which has previously been treated by a chemical process consisting in forming a precipitate in the effluent from ferrous ions and copper ions, by which the radiochemical ruthenium 106 activity of the effluent is reduced to 3180 microcuries per $m^3$.

This effluent has the following characteristics:

| | |
|---|---|
| Chemical | |
| pH | 7.7 |
| redox potential/SCE mV | +294 |
| dry extract g/l | 22 |
| $PO_4^{3-}$ mg/l | 70 |
| Radiochemical in $1.10^{-6}$Ci/$m^3$ | |
| $^{90}Sr$ | 770 |
| $^{103}Ru$ | 50 |
| $^{106}Ru$ | 3180 |
| $^{125}Sb$ | 900 |
| $^{134}Cs$ | 3450 |
| $^{137}Cs$ | 15750 |

In these different tests, the copper ions are introduced into the liquid effluent electrochemically, and the effect of the following parameters is studied:

(a) hydrazine concentration
(b) pH of the effluent
(c) density of electrodissolution current, and
(d) quantity of cuprous oxide formed, on the ruthenium 106 decontamination factor (FD).

(a) Effects of the hydrazine concentration on the ruthenium decontamination factor In these tests, the pH of the solution is adjusted beforehand to a value of 9.3, then different quantities of hydrazine are added to the effluent and subsequently the effluent is subjected to electrolysis in an electrolysis cell comprising 2 copper electrodes, at a current density of 50 milliamperes per $cm^2$, the quantity of electricity being 4 mF per liter.

After electrodissolution of the copper, the precipitates formed in the liquid effluent are eliminated by decanting for 30 minutes, then the supernatant phase is filtered or clarified by adding aluminium hydroxide to eliminate the cuprous oxide remaining in colloidal form.

The results obtained with various concentrations of hydrazine are assembled in Table 1 as follows.

| Quantity of hydrazine added mol/l of effluent | Final pH after 30 min. | Oxy reduction potential after 30 min e/SCE mV | Colour of precipitate | $FD^{106}Ru$ supernatant filtered | $FD^{106}Ru$ supernatant clarified |
|---|---|---|---|---|---|
| 0 | 9.6 | 65 | blue | 1.1 | 1.2 |
| $1.10^{-3}$ | 9.4 | −110 | yellowish-green | 2.9 | 3.8 |
| $2.10^{-3}$ | 9.4 | −113 | orange | 2.9 | 3.9 |
| $4.10^{-3}$ | 9.4 | −110 | orange | 3.2 | 3.9 |
| $1.10^{-2}$ | 9.4 | −115 | orange | 3.4 | 3.9 |

From these results it can be seen that at least $1.10^{-3}$ mole of hydrazine per liter must be used to convert the copper ions produced in the effluent into cuprous oxide.

For high concentrations of hydrazine, for example more than $2.10^{-3}$ mole per liter, floating of the precipitates occurs, as a result of the formation of fine nitrogen bubbles in the decanted material, even through the latter is particularly dense; the volume of sludge is substantially equal to 2 ml per liter of effluent after 30 min.

(b) Effects of the pH of the effluent on the ruthenium decontamination factor FD In these tests, radioactive effluents with initial pH values of from 2 to 11 are used.

After $2.10^{-3}$ mole per liter of hydrazine has been added to these effluents, the effluent is subjected to electrolysis in a cell comprising copper electrodes at a current density of 50 milliamperes per $cm^2$, whilst the quantity of electricity used is 4 mF per liter. In this way, electrodissolution of about $2.10^{-3}$ mole of copper per liter of effluent is carried out. After electrodissolution of the copper, the pH is adjusted to 9.5 for all the tests carried out at a pH of less than 9. After stirring the effluent for 30 min., the precipitates obtained are decanted and the supernatant phase is subjected to filtration before its ruthenium activity is determined. The results obtained are shown in Table 2 below.

| initial pH | pH obtained after anode dissolution of copper | redox potential $_e$mV/SCE at adjusted pH 9.5 or at final unchanged pH: after 5 min | after 15 min | after 30 min | colour of precipitate obtained at final pH after 30 min | $FD^{106}Ru$ supernatant filtered |
|---|---|---|---|---|---|---|
| 2 | 2.2 | −50 | +9 | +7 | blue | 1.2 |
| 4 | 5.2 | −20 | 0 | +5 | blue | 1.4 |
| 7 | 7 | 100 | 80 | 70 | blue | 1.4 |
| 8 | 8.8 | −60 | −66 | −50 | greenish | 2.9 |
| 9 | 9.4 | −100 | −105 | −100 | orange-yellow | 3.8 |
| 10.1 | 10.3 | −60 | −100 | −102 | orange-yellow | 2.3 |
| 11 | 11.2 | −150 | −160 | −163 | dark orange | 1.9 |

This table shows that the formation of cuprous oxide is impossible at pH values of less than 9, and the colour of the precipitates obtained does not correspond to the formation of a cuprous oxide precipitate. Moreover, it should be noted that at pH values of above 10 the ruthenium retaining power of the precipitate decreases.

(c) Effects of the density of the electrodissolution current on the ruthenium decontamination factor FD In these tests, $2.10^{-3}$ mole of hydrazine per liter of effluent are added to a liquid effluent the initial pH of which has been adjusted to 9.3, and this effluent is subjected to electrolysis in a cell comprising copper electrodes, at different current densities, whilst the quantity of electricity used is 4 mF per liter. After electrodissolution of the copper, the effluent is decanted for 30 minutes and the supernatant phase is clarified using 10 mg of aluminium hydroxide per liter of effluent.

After clarification, the ruthenium activity of the supernatant phase is measured. The results obtained are shown in Table 3 below.

| i $1.10^{-3}$ $A.cm^{-2}$ | pH 30 min. | redox potential after 30 min. $e^{mV}$/SCE | colour of precipitate initially | colour of precipitate after 30 mn. | form of precipitate | $FD^{106}Ru$ supernatant clarified |
|---|---|---|---|---|---|---|
| 5 | 9.4 | −120 | orange-yellow | orange | highly colloidal | 3.4 |
| 10 | 9.3 | −110 | orange-yellow | " | highly colloidal | 3.5 |
| 25 | 9.4 | −100 | green-yellow | " | colloidal | 3.9 |
| 50 | 9.4 | −106 | green- | " | " | 3.9 |

-continued

| i $1.10^{-3}$ $A.cm^{-2}$ | pH 30 min. | redox potential after 30 min. $e^{mV}$/SCE | colour of precipitate initially | colour of precipitate after 30 mn. | form of precipitate | $FD^{106}Ru$ supernatant clarified |
|---|---|---|---|---|---|---|
| 100 | 9.5 | −106 | yellow green-yellow | " | " | 3.9 |
| 200 | 9.4 | −110 | green-yellow | " | " | 3.5 |

This table shows that for current densities less than or equal to 10 milliamperes per $cm^2$, as soon as the electrodissolution of the copper is complete, a yellowish-orange cuprous oxide precipitate is obtained, corresponding to a reduction speed of the copper ions which is greater than or equal to their speed of formation in the effluent.

For higher current densities, a greenish-yellow precipitate is obtained which develops in 10 to 15 minutes into an orange-coloured precipitate corresponding to the formation of cuprous oxide.

Moreover, it is found that for current densities of less than 25 $mA/cm^2$ the precipitates obtained are highly colloidal.

(d) Effects of the quantity of cuprous oxide formed on the ruthenium decontamination factor In these tests, $2.10^{-3}$ mole of hydrazine per liter of effluent are added to the radioactive liquid effluent, the pH of which is adjusted to 9.5, then the effluent is subjected to electrolysis in an electrolysis cell comprising copper electrodes, at a current density of 50 $mA/cm^2$, whilst the quantity of electricity used for electrochemically producing the copper ions in the liquid effluent is varied. After 30 minutes the pH and the redox potential of the effluent thus treated are checked, then the ruthenium activity of the supernatant phase, filtered on a Millipore AP 20 filter (AFNOR standard) or clarified with 10 mg/l of aluminium hydroxide, is determined.

The results obtained are given in Table 4.

| Quantity of electricity used $mF.1^{-1}$ | Characteristics of the effluent after 30 minutes: pH | redox potential e mV/SCE | $FD^{106}Ru$ supernatant filtered | $FD^{106}Ru$ supernatant clarified |
|---|---|---|---|---|
| 1 | 9.5 | −98 | 1.4 | 3 |
| 2 | 9.6 | −105 | 2 | 3.1 |
| 3 | 9.6 | −102 | 2.6 | 3.8 |
| 4 | 9.6 | −107 | 2.8 | 3.6 |

This Table shows that the best results are obtained when the quantity of electricity used is more than 3 mF/l.

Moreover, it is found that for small quantities of electricity (1 and 2 mF/l) the precipitate obtained is highly colloidal.

In view of the results obtained in tests (a) to (d) it appears that the preferred operating conditions are as follows:

pH of the effluent between 9 and 10, quantity of hydrazine added: 1 to $2.10^{-3}$ mole of hydrazine per liter of effluent, quantity of copper ions added: 1 to $2.10^{-3}$ mole of copper per liter of effluent, corresponding to about 65 to 130 mg of copper per liter of effluent.

However, with regard to the pH, it should be noted that the optimum value indicated above corresponds to an effluent the content of phosphate ions of which is equal to or greater than about $1\times10^{-3}$ mol. $1^{-1}$. On the other hand, in the absence of phosphate ions, experience has shown that the pH of the effluent needed only to be brought to a value of more than 7.

EXAMPLE 3

This example illustrates the influence of the molar ratio of hydrazine to copper ions, i.e. the stoichiometric ratio R=hydrazine concentration/copper ion concentration, and the influence of the quantity of cuprous oxide formed in the effluent, on the ruthenium 106 decontamination factor (FD) obtained.

In these tests, two types of effluent I and II are treated, in which the ruthenium 106 activities are 18,530 microcuries per $m^3$ and 3,180 microcuries per $m^3$, respectively. Effluent II has the characteristics indicated in Example 2 and effluent I has the following characteristics:

| | |
|---|---|
| Chemical | |
| pH | 9.2 |
| Redox potential/SCE mV | +390 |
| dry extract g/l | 27.5 |
| $PO_4^{3-}$ mg/l | 325 |
| Radiochemical in $1.10^{-6}$ $Ci/m^3$ | |
| $^{90}Sr$ | not determined |
| $^{103}Ru$ | 270 |
| $^{106}Ru$ | 18530 |
| $^{125}Sb$ | 2230 |
| $^{134}Cs$ | 1580 |
| $^{137}Cs$ | 6120 |

After the pH of the liquid effluent has been adjusted to 9.5, variable amounts of hydrazine hydrate and $2.10^{-3}$ mole of copper ions per liter of effluent are introduced into the effluent, the copper ions being added to the solution in the form of copper sulphate. After stirring for 30 minutes, the effluent is clarified with an anionic polyelectrolyte, then the radiochemical ruthenium 106 activity of the supernatant phase is determined after the precipitate has been decanted.

The results obtained for different values of the stoichiometric ratio R are given in Table 5, and the results obtained by varying the quantity of cuprous oxide produced in the liquid effluent with R=1 are given in Table 6.

TABLE 5

| R | FD in $Ru^{106}$ Effluent I | FD in $Ru^{106}$ Effluent II | Remarks |
|---|---|---|---|
| 0.5 | 2.1 | 1.5 | Greenish-yellow precipitate; the conversion into $Cu_2O$ is incomplete. |
| 1 | 2.8 | 1.6 | Orange-yellow precipitate |
| 1.5 | 2.9 | 1.6 | Floating of precipitates |

TABLE 5-continued

| R | FD in $Ru^{106}$ Effluent I | Effluent II | Remarks |
|---|---|---|---|
| 2 | 2.9 | 1.6 | Floating of precipitates |

TABLE 6

| R imposed = 1 Quantity of cuprous oxide formed $1.10^{-3}$mol.$l^{-1}$ | FD in $Ru^{106}$ Effluent I | Effluent II | Volumes of sludge observed ml.$l^{-1}$ (order of magnitude) |
|---|---|---|---|
| 0.5 | 2.4 | 1.6 | 8 |
| 1 | 2.8 | 1.6 | 15* |
| 2 | 3.3 | 1.7 | 20 |

These tables show that the best results are obtained under the following conditions: stoichiometric ratio R greater than 0.5 and preferably of the order of 1.

quantity of cuprous oxide produced in the liquid effluent of the order of 1 to $2.10^{-3}$ mole per liter of effluent.

Thus, when the copper ions are added in the form of a reagent, the optimum conditions of pH=9 to 10, quantity of hydrazine added=1 to $2.10^{-3}$ mol.$l^{-1}$ and quantity of copper ions added=1 to $2.10^{-3}$ mol.$l^{-1}$ are substantially the same as those given in Example 2.

EXAMPLE 4

This example illustrates the results obtained in ruthenium decontamination tests on effluent I above, having a ruthenium 106 activity of 3,180 microcuries per $m^3$, these tests being carried out on 200 l of effluent, the pH of which has been adjusted to 9.

In these tests, $2.10^{-3}$ mole of hydrazine per liter of effluent are added, and $2.10^{-3}$ mol.$l^{-1}$ of copper ions are added either in the form of a chemical compound, or directly, by generating them electrochemically in the effluent.

After the addition or direct formation of the copper ions, the effluent is stirred for 30 mins to ensure that all the copper has been converted into cuprous oxide, then the precipitates are decanted, optionally after flocculation by means of an anionic polyelectrolyte added in an amount of 1 mg/l, and the ruthenium decontamination factor FD is determined by measuring the $Ru^{106}$ activity of the supernatant phase.

Moreover, certain physico-chemical characteristics of the sludges and supernatant phase are determined. These characteristics are:

Total suspended matter (TSM)

This is the quantity of solids present in 1 liter of supernatant phase, after filtering on a MILLIPORE AP 20 filter (AFNOR standard) and drying at 105° C. The result is expressed in mg.$l^{-1}$.

Dry content (DC)

Quantity of solids measured after drying, at 105° C., the sludges obtained by decanting 1 liter of effluent.

Level of dry matter (LDM)

Percentage of dry matter at 105° C. present in a sludge after decanting.

Concentration factor (CF)

This is the ratio of the volume of effluent chemically treated to the volume of sludge obtained after a certain decanting time. The measurement is carried out in a COIN cone after 2 hours' decanting. A COIN cone is a cylindrical/conical container the cone of which, located at the bottom of the container, has an apex angle of about 10°.

The results obtained are assembled in Table 7.

| Parameters observed | Introduction of copper $2.10^{-3}$: Added in form of reagent $2.10^{-3}$ mol. $1^{-1}$ | Electrodissolution $2.10^{-3}$ mol. $1^{-1}$: $i = 1.10^{-2}A\ cm^{-2}$ | $i = 2.5.10^{-2}A\ cm^{-2}$ | |
|---|---|---|---|---|
| CF, COIN cone 2h | 166 | 500 | 666 | with no added poly-electro-lyte |
| TSM (supernatant) mg.$l^{-1}$ | 18 | 26 | 18 | |
| Characteristics of effluent before decanting | | | | |
| DC filter AP 20 mg.$l^{-1}$ | 103 | 10 | 17 | |
| DC filter 5μ mg.$l^{-1}$ | 158 | 130 | 155 | |
| Characteristics of sludges | | | | |
| LDM g/100g sludges | 2.6 | 6.5 | 10.3 | |
| FD | 1.7 | 2.5 | 3 | with added poly-electro-lyte |
| CF, COIN cone 2 h | 17 | 29 | 43 | |
| TSM mg/l | 3 | 5 | 5 | |

These results show that the decontamination factors FD and the concentration factors CF obtained are higher when the $Cu^{2+}$ ions are produced directly in the effluent by electrochemical means and in the best case the residual 106 Ru activity of the effluent is $1.10^{-3}$ curies per $m^3$.

Moreover, the cuprous oxide obtained from the copper produced by electrodissolution in the presence of hydrazine is in the form of colloidal particles having smaller dimensions than the cuprous oxide obtained by the addition of copper ions in the form of chemical compounds.

In fact, 7 to 11% of the particles are trapped by a MILLIPORE AP 20 filter when the copper is introduced electrochemically, whereas 70% of the particles are trapped by the same filter when the copper is added in the form of copper sulphate.

In every case, filtration through a filter with a porosity of 5 microns results in a clear filtrate.

After decanting the cuprous oxide precipitate without adding any polyelectrolyte, the formation of a partially dehydrated sludge is observed, this phenomenon being particularly important after the electrodissolution of the copper (CF approximately 500, LDM: 6 to 10%); the TSM characteristic of the supernatant phase is then sufficiently low for filtration to be used as a method of clarification. This filtration, after 2 hours' decanting, is carried out rapidly and without clogging when no polyelectrolyte is used, which is not the case when a polyelectrolyte is added. In effect, by filtering 0.5 l of supernatant phase on a MILLIPORE filter with a porosity of 5 microns, and a diameter of 35 mm, the following results are obtained:

2.4 meters per minute with no polyelectrolyte added, 0.06 meters per minute after the addition of 1 mg per liter of PURIFLOC A 22.

The above values are expressed as the height of the column of liquid (corresponding to the diameter of 35 mm).

Thus the method of the invention proves very useful for reducing the residual ruthenium activity of effluents, either crude or treated beforehand by a chemical process, especially when the copper is introduced electrochemically, resulting in a higher concentration factor.

Moreover, a secondary advantage of the electrochemical method is the fact that, by producing hydrogen in the electrolysis cell, the amount of hydrazine to be used can be reduced slightly.

The invention is not limited to the embodiments described and represented hereinbefore and various modifications can be made thereto without passing beyond the scope of the invention.

What is claimed is:

1. A method of removing ruthenium contamination from a radioactive liquid effluent, consisting in adding to said liquid effluent a reducing agent and cupric ions, to form, in said effluent, a cuprous oxide precipitate on which the ruthenium is fixed, and subsequently separating the precipitate thus formed from the effluent.

2. A method according to claim 1, wherein said reducing agent is hydrazine.

3. A method according to claim 1, wherein the pH of said liquid effluent is adjusted beforehand to a value of between 7 and 10.

4. A method according to claim 2, wherein the cupric ions are produced directly in said effluent by an electrochemical method, by subjecting said effluent to electrolysis in a cell comprising a copper anode.

5. A method according to claim 2, wherein the quantities of hydrazine and cupric ions added to said effluent are such that the molar ratio of hydrazine to cupric ions is between 0.5 and 1.

6. A method according to claim 2, wherein the amount of hydrazine added to said effluent is between 1 and $2\times10^{-3}$ mole of hydrazine per liter of effluent.

7. A method according to claim 1, wherein the amount of cupric ions added to said effluent is between 1 and $2\times10^{-3}$ mole of cupric ions per liter of effluent.

8. A method according to claim 1, wherein the precipitate formed in said effluent is separated off by passing it into a hydrocyclone and subsequently filtering it.

* * * * *